US007997451B2

(12) United States Patent
Carnacina

(10) Patent No.: US 7,997,451 B2
(45) Date of Patent: Aug. 16, 2011

(54) FLUID PRODUCT DISPENSING MEMBER AND A DISPENSER PROVIDED THEREWITH

(75) Inventor: Simone Carnacina, Gallarate (IT)

(73) Assignee: Valois SAS, Le Neubourg (FR)

( * ) Notice: Subject to any disclaimer, the term of this patent is extended or adjusted under 35 U.S.C. 154(b) by 496 days.

(21) Appl. No.: 12/093,050

(22) PCT Filed: Nov. 9, 2006

(86) PCT No.: PCT/FR2006/051159
§ 371 (c)(1),
(2), (4) Date: Aug. 25, 2008

(87) PCT Pub. No.: WO2007/057600
PCT Pub. Date: May 24, 2007

(65) Prior Publication Data

US 2009/0218369 A1 Sep. 3, 2009

(30) Foreign Application Priority Data

Nov. 10, 2005 (FR) ..... 05 53422

(51) Int. Cl.
*B67B 1/00* (2006.01)

(52) U.S. Cl. ..... 222/153.11; 222/153.13; 222/321.7; 222/321.9

(58) Field of Classification Search ..... 222/153.11, 222/153.12, 153.13, 321.7, 152, 321.8, 321.9, 222/321.6; 239/333
See application file for complete search history.

(56) References Cited

U.S. PATENT DOCUMENTS

| | | | | |
|---|---|---|---|---|
| 3,306,497 | A | 2/1967 | Kenney et al. | |
| 3,348,740 | A * | 10/1967 | O'Donnell | 222/153.06 |
| 3,422,996 | A * | 1/1969 | Lipman | 222/402.11 |
| 4,410,107 | A * | 10/1983 | Corsette | 222/321.7 |
| 4,424,919 | A * | 1/1984 | Knox et al. | 222/153.13 |
| 4,434,915 | A | 3/1984 | Kirk, Jr. | |
| 5,096,094 | A * | 3/1992 | Guilbert | 222/153.13 |
| 5,222,632 | A | 6/1993 | Tada | |
| 5,772,080 | A * | 6/1998 | de Pous et al. | 222/321.7 |
| 6,196,423 | B1 * | 3/2001 | Erxleben | 222/153.1 |
| 6,601,735 | B2 * | 8/2003 | Milian et al. | 222/153.11 |
| 6,626,330 | B2 * | 9/2003 | Ritsche | 222/153.02 |
| 6,695,171 | B2 * | 2/2004 | Walters et al. | 222/153.13 |

FOREIGN PATENT DOCUMENTS

| | | |
|---|---|---|
| EP | 0 151 973 A2 | 8/1985 |
| EP | 0 572 903 A1 | 12/1993 |
| JP | 08-011957 A | 1/1996 |

* cited by examiner

*Primary Examiner* — Frederick C. Nicolas
(74) *Attorney, Agent, or Firm* — Sughrue Mion, PLLC

(57) ABSTRACT

A fluid dispenser member for associating with a fluid reservoir (3). The member has a body (1), a fastener ring (2) for holding the body in stationary manner relative to the reservoir (3), a covering hoop (6) that is engaged in stationary manner around the fastener ring (2), an actuator rod (15) that is axially movable down and up in the body (1), and a pusher (4) that is mounted on the actuator rod (15). The pusher is provided with a dispenser orifice (44). The dispenser member is provided with a blocking mechanism (49, 5, 62) that is secured to the hoop so as to prevent the pusher from turning on the actuator rod relative to the body, and consequently relative to the reservoir, such that the pusher is movable only axially. The blocking mechanism includes at least one longitudinal axial guide (55).

12 Claims, 2 Drawing Sheets

FLUID PRODUCT DISPENSING MEMBER AND A DISPENSER PROVIDED THEREWITH

Figure 1:
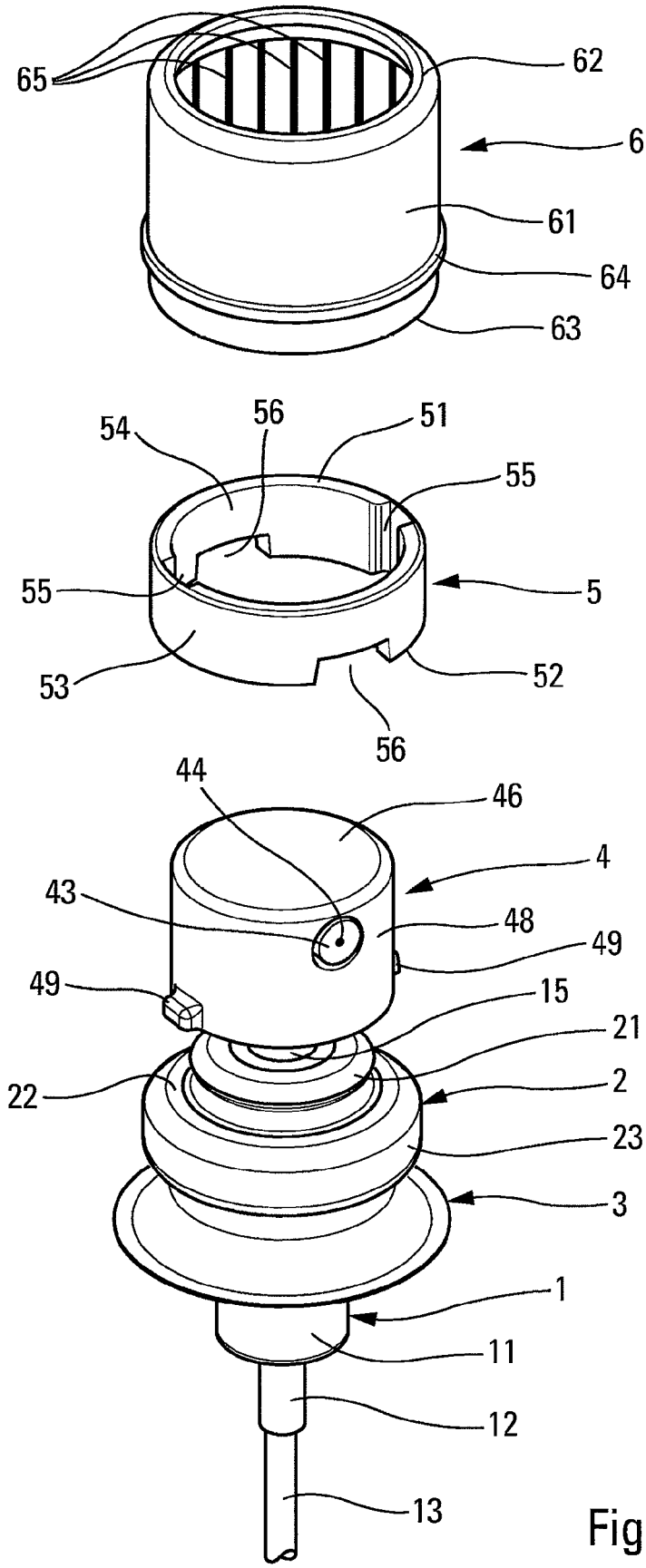

The present invention relates to a fluid dispenser member for associating with a fluid reservoir so as to constitute a fluid dispenser. In addition, the present invention also relates to the dispenser, itself comprising the dispenser member of the invention and a fluid reservoir. Such a dispenser member and such a dispenser are frequently used in the fields of perfumery, cosmetics, or even pharmacy.

The dispenser member may be a pump or a valve. However, other types of dispenser member are not excluded. Nevertheless, for a pump or a valve, the dispenser member generally comprises: a body; a fastener ring for holding the body in stationary manner relative to the reservoir; a covering hoop that is engaged in stationary manner around the fastener ring; an actuator rod that is axially movable down and up in the body; and a pusher that is mounted on the actuator rod, the pusher advantageously being provided with a dispenser orifice. This is an entirely conventional design for a pump or a valve in the fields of perfumery, cosmetics, and pharmacy. In order to dispense fluid, it suffices to press on the pusher using one or a more fingers so as to move the actuator rod inside the body. In response, an optionally-measured quantity of fluid is dispensed through the dispenser orifice.

Given that the pusher is mounted on the actuator rod, it is free to turn about its own axis on the actuator rod. As a result, the dispenser orifice can be positioned at any angle relative to the body, and consequently relative to the reservoir.

An object of the present invention is to remedy that drawback by defining a dispenser member having an angular position for the dispenser orifice relative to the body and relative to the reservoir that is unchanging and determined.

To achieve this object, the present invention proposes blocking means that are secured to the hoop so as to prevent the pusher from turning on the actuator rod relative to the body, and consequently relative to the reservoir, such that the pusher is movable only axially, the blocking means including at least one longitudinal axial guide that advantageously co-operates with the pusher. Thus, the angular orientation of the dispenser orifice is set relative to the body, and it suffices to orientate the body correctly relative to the reservoir in order to determine the angular orientation of the dispenser orifice relative to the reservoir. This is particularly useful when the cross-section of the reservoir presents a configuration that is not circular. For example, the reservoir body may present a configuration that is flat in one direction. In this event, the user always takes hold of the reservoir in the same way, and it is thus imperative for the dispenser orifice to be oriented appropriately so as to ensure that dispensing is always well oriented.

In another aspect of the invention, the blocking means prevent the pusher from being removed from the actuator rod. Thus, the blocking means not only prevent the pusher from turning, but also provide a high-abutment function that prevents the pusher from being removed from the actuator rod. Thus, not only is it impossible to lose the pusher, but it is also impossible to remove it deliberately in order to access the actuator rod.

In an advantageous embodiment, the pusher includes at least one lug that projects outwards, the lug being engaged in a respective longitudinal axial guide, the lug and the guide co-operating with each other to form the blocking means for preventing turning.

The axial guide is advantageously closed at its top end, such that the lug butts against the guide end when an attempt is made to remove the pusher from the actuator rod.

In another aspect of the invention, the blocking means comprise a guide bushing that is received in stationary manner in the hoop and that is engaged around the pusher, the bushing forming at least one longitudinal axial guide.

Advantageously, said at least one guide comprises an inner axial groove.

The hoop advantageously includes a top end formed with an inwardly-directed shoulder that closes the top end of the groove formed in the bushing.

The hoop preferably includes fastener profiles, such as splines or grooves, on or in its inside wall, the profiles coming into engagement with the bushing so as to prevent it from turning in the hoop.

Advantageously, the profiles also come into engagement with the fastener ring so as to prevent the hoop from turning on the fastener ring. The profiles of the hoop thus provide relative blocking between the bushing and the fastener ring.

In another aspect of the invention, the bushing is surrounded by the hoop and is jammed between the inwardly-directed shoulder of the hoop and the fastener ring. The bushing is thus prevented from turning by the hoop, and is blocked in axial translation by being jammed between the hoop and the ring.

In an advantageous embodiment, the hoop may be made of metal and the bushing may be made of plastics material. In addition, the fastener ring may be made of plastics material or of metal.

The invention also defines a fluid dispenser comprising a reservoir and a dispenser member as defined above, the reservoir advantageously presenting a cross-section that is not circular. This is an advantageous application in which it is useful, indeed indispensable, for the angular orientation of the dispenser orifice relative to the reservoir to be unchanging.

The invention is described more fully below with reference to the accompanying drawings which show an embodiment of the invention by way of non-limiting example.

Figure 3:
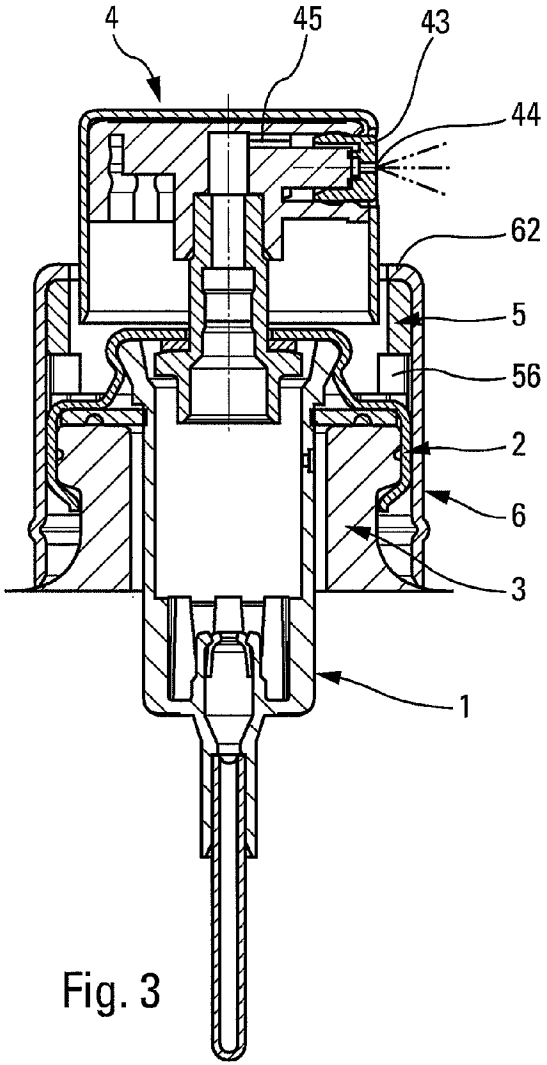
Figure 2:
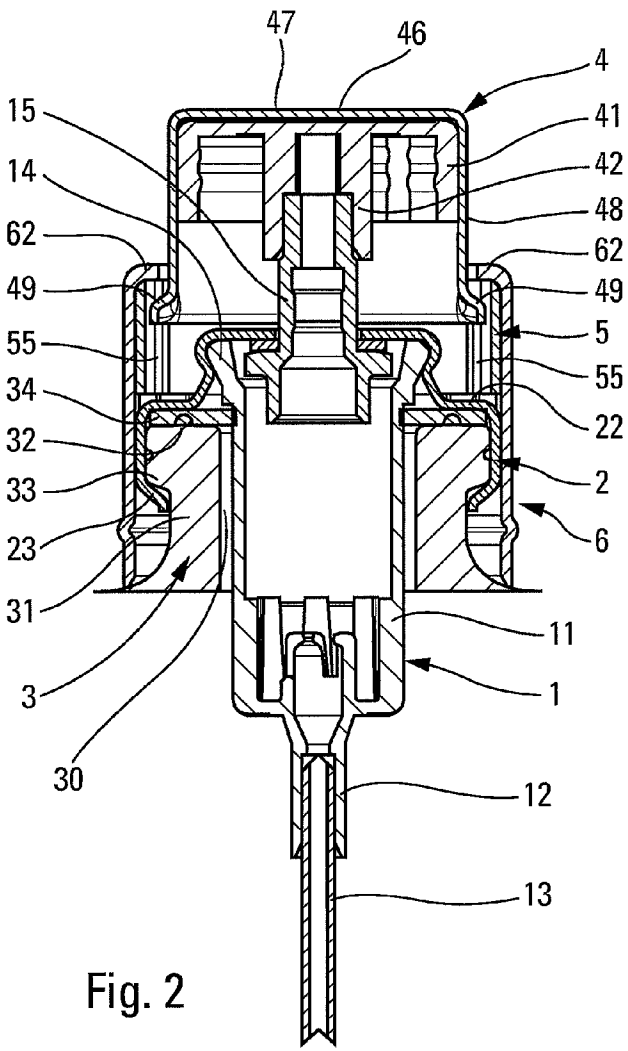

In the figures:

FIG. 1 is an exploded perspective view of a dispenser member constituting a non-limiting embodiment of the invention; and FIGS. 2 and 3 are vertical-section views along perpendicular section planes of the FIG. 1 dispenser member.

Reference is made indifferently to all of the figures for explaining in detail the structure and the operation of the fluid dispenser member constituting this particular embodiment. The dispenser member described below incorporates a pump or a valve. In addition, in FIGS. 2 and 3, the internal structure of the dispenser member is not shown since it does not interfere with the characteristics of the present invention. Furthermore, regardless of whether it is a pump or a valve, this type of dispenser member comprises a body 1, an actuator rod 15, and a dispenser head in the form of a pusher 4. More precisely, the body 1, which is preferably made of injected-molded plastics material, comprises a cylinder 11 that is extended at its bottom end by an inlet tube 12 that is advantageously provided with a dip tube 13. At its top end, the cylinder 11 is terminated by a collar 14 that projects outwards. The actuator rod 15 is engaged inside the body, but a portion of the rod projects axially upwards out from the body. The actuator rod is axially movable down and up inside the body against the action of a spring (not shown). The actuator rod 15 is urged by the spring towards the rest position shown in FIGS. 2 and 3. The actuator rod 15 internally defines a delivery duct for the fluid. The free end of the actuator rod 15 projects out from the body and is in engagement with the pusher 4.

In this embodiment, the pusher 4 comprises a core 4 that is advantageously made of plastics material, and an outer casing 46 that is advantageously made of metal. The core 41 includes a connection sleeve 42 for fitting on the free end of the actuator rod 15. Internally, the core forms an outlet channel 45 that leads to a dispenser orifice 44 that is formed by a nozzle 43 that is fitted in the core 41. The nozzle 43 preferably makes it possible to dispense the fluid in the form of a spray. The casing 46 surrounds the core 41 leaving only the nozzle 43 visible. The casing 46 includes a top bearing wall 47 on which the user can press using one or more fingers. The top bearing wall 47 is extended downwards over its outer periphery by a skirt 48 of substantially cylindrical shape in this embodiment. In the invention, the skirt 48 includes at least one lug 49 that projects radially outwards. In the non-limiting embodiment in the figures, the skirt 48 is provided with two lugs 49 that are disposed in diametrally opposite manner. It is also possible to provide only a single lug, or, alternatively, more than two lugs. In this embodiment, the lugs 49 are disposed at the bottom edge of the skirt 48. However, it is possible to form the lugs a little higher on the skirt. In this embodiment, the lugs 49 are formed directly by the casing 46. It is also possible to make lugs 49 that are fitted on the casing, or more generally on the pusher. In addition, in the embodiment used to illustrate the invention, the pusher 4 is made with an inner core and an outer casing. It is also possible to imagine a pusher that does not have an outer casing, so that it is formed only by a core, e.g. made of plastics material. In this event, the skirt 48 would be formed directly by the core, and the lugs 49 would be formed integrally with the skirt made of plastics material. In other words, the particular kind of pusher used in the present invention is not a critical characteristic, it suffices that the pusher is provided with one or more lugs that project radially outwards.

In the figures, the dispenser member is mounted on a reservoir 3. Only a very small part of the reservoir is shown, since only the neck 31 of the reservoir can be seen in the figures. The reservoir neck is a structure that is entirely conventional, and that includes a top annular edge 32 that can advantageously be provided with an annular sealing bead. The neck 31 also forms a rim 33 that projects downwards and outwards. The bottom rim 33 serves as a fastener zone for fastening the body 1 in the opening 30 formed by the neck 31.

In the embodiment used to illustrate the present invention, the body 1 is held on the neck 31 by means of a fastener ring 2 that is specifically a crimping ring. The ring 2 comprises a portion 23 in engagement around the neck 31, and a portion 21 in engagement around the collar 14 of the body 1. More precisely, the portion 23 of the ring is crimped under the rim 33 of the neck, and the portion 21 is crimped under the collar 14 of the body. To provide sealing at the neck, a neck gasket 34 is advantageously provided that is compressed between the ring 2 and the top annular edge 32. At this level, the ring forms an annular flange 22 that extends substantially horizontally. Instead of the crimping ring, it is also possible to use a screw-fastener ring, a snap-fastener ring, or even a ring that is suitable for being blocked under the rim 33 of the neck. The fastener ring can be made of plastics material, or of metal, as with the crimping ring shown in the figures. In this event, the crimping ring also serves as a ferrule, defining the top dead center or rest point for the actuator rod 15. In the rest position shown in FIGS. 2 and 3, the actuator rod 15 is urged against the fastener ring 2 by the spring (not shown).

The dispenser member also includes a covering hoop 6 that is engaged permanently and in stationary manner around the ring 2, a portion of the neck 31, and a portion of the pusher 4. The hoop 6 presents a general configuration that is substantially cylindrical and that comprises a main cylinder 61 that is substantially cylindrical and that is terminated at its top end by an inwardly-directed shoulder 62. The cylinder 61 also defines an annular bead 64 that projects outwards, and that is situated in the proximity of the bottom end 63 of the cylinder. The bead 64 can serve to hold a protective cap that covers the pusher. Internally, the cylinder 61 forms fastener profiles 65 that are in the form of splines or grooves that are disposed vertically. As can be seen in FIG. 1, the profiles are not visible from the outside of the cylinder 61. However, they could be. The hoop 6 is thus engaged around the ring 2 in such a manner that the profiles 65 of the hoop 6 come into clamping engagement with the outside wall of the ring 2, particularly at the portion 23. The fastener profiles 65 make it possible to fasten the hoop 6 effectively on the ring 2. In the final assembly position, the bottom end 63 of the hoop comes into abutment on the reservoir, as can be seen in FIGS. 2 and 3. As a result of the vertical, axial, or longitudinal disposition of the profiles 65, the hoop 6 is prevented very effectively from turning on the ring 2. Regardless of whether the profiles are grooves or splines, the ring 2 is deformed either around the splines or inside the grooves. The deformation of the ring holds the hoop in stable manner, preventing it hoop from turning on the ring. This is valuable, regardless of whether the ring is made of metal or of plastics material. Naturally, when the ring is made of plastics material, the grip is better. Advantageously, the covering hoop 6 is made of metal, whereas the fastener ring 2 can be made of metal or of plastics material. However, the hoop could be made out of a plastics material that advantageously presents hardness that is greater than the hardness of the plastics material constituting the ring.

As described above, the dispenser member is of a design that is entirely conventional, except for the presence of the lugs 49.

In an embodiment of the invention, the dispenser member includes rotation-blocking means for blocking the pusher in a determined orientation. The blocking means can be in the form of a guide bushing 5 that is advantageously made of plastics material. With reference to FIG. 1, it can be seen that the bushing 5 comprises a top edge 51, a bottom edge 52, an outside wall 53, and an inside wall 54. The inside wall 54 is formed with two longitudinal guide grooves 55 that connect the top edge 51 to the bottom edge 52. The grooves 55 form recesses in the inside wall 54. The wall thickness of the bushing at the grooves 55 is thus reduced. It can be said that the grooves 55 are open both upwards and downwards, respectively at the top edge 51 and at the bottom edge 52. The bushing 5 is also made with two notches 56 that are formed in diametrally opposite manner in the bottom edge 52. The notches 56 extend over a small radial extent and connect the outside wall 53 to the inside wall 54. The bushing 5 is engaged inside the hoop 6 in such a manner that its outside wall 53 comes into engagement with the inside wall of the hoop 6. When the hoop 6 is made with fastener profiles 65, the outside wall 53 comes into engagement with the profiles 65 in such a manner as to prevent the bushing 5 from turning inside the hoop 6. Grip is all the better when the bushing 5 is made of plastics material and the hoop 6 is made of metal. Thus, the plastics material constituting the bushing 5 can either creep into the grooves formed inside the hoop 6 or deform around the splines formed inside the hoop 6. In addition, the bushing 5 is engaged around the pusher 4 with the lugs 49 that come to be housed in the guide grooves 55. In the final assembly position shown in FIGS. 2 and 3, the bushing 5 rests on the fastener ring 2. More precisely, the bottom edge 52 of the bushing 5 comes to bear against the flange 22 of the ring 2. On the opposite side, the top edge 51 comes into engagement under the inwardly-directed shoulder 62 of the hoop 6. Thus, the bushing is jammed between the ring 2 and the hoop 6. In addition, the bushing 5 is prevented from turning inside the hoop 6, and the hoop 6 is prevented from turning on the ring 2. In this way, it is guaranteed that the bushing 5 is blocked relative to the body 1 of the dispenser member both against turning and against moving in axial translation. In addition, as a result of the lugs 49 being engaged in the guide grooves 55, it is certain that the pusher 4 can be moved axially with the lugs 49 sliding in the grooves 55, but that the pusher cannot be turned about its own axis, since the lugs 49 cannot be disengaged from the grooves 55. Furthermore, it is impossible to remove the pusher 4 from the actuator rod 15 as a result of the lugs 49 coming into abutment under the inwardly-directed shoulder 62 of the hoop 6. Thus, not only is the pusher prevented from turning, but it is also held captive.

The function of the notches 56 is to orientate the bushing in the hoop, and then to orientate the bushing-and-hoop assembly relative to the reservoir that has already been fitted with the pump or with the valve by means of the fastener ring. Finally, the pusher is oriented relative to the reservoir.

Instead of a hoop 6 and a bushing 5, which constitute distinct elements in this embodiment, it is also possible, in the ambit of the invention, to envisage making a hoop 6 that incorporates guide grooves 55. The rotation-blocking means are thus integrated in the hoop. It is possible to imagine that the inside wall of the hoop 6 forms one or more guide grooves that are similar or identical to the grooves 55 of the bushing 5. It is even possible to imagine that the fastener profiles 65 are made in the form of splines that serve to guide the pusher axially in such a manner as to prevent it from turning. In this event, the pusher can include a periphery that is configured to co-operate with the splines of the hoop so as to provide axial guidance. However, it is advantageous to use a bushing 5 that is distinct from the hoop 6, since it is thus possible to make a bushing 5 of plastics material that serves as a plastic interface between the metal hoop 6 and the metal casing 46 of the pusher 4. The lugs 49 that are advantageously formed by the metal casing 46 of the pusher, thus slide inside the guide grooves 55 that are made of plastics material. It is well known that a metal on plastic contact offers better results than a metal on metal contact that can generate undesirable noise and friction.

A principle of the invention is to use a conventional component element of the dispenser member, specifically the hoop, for receiving in stationary manner, or for forming rotation-blocking means. Either way, the blocking means are secured to the hoop.

Another advantageous principle of the invention resides in the fact that the pusher is formed with at least one outwardly-projecting element that is engaged in a longitudinal axial guide, such as the grooves 55. Another advantageous characteristic of the invention resides in the fact that the pusher is prevented from turning while the dispenser member is being assembled on the reservoir neck. It is the covering hoop 6 that is mounted last that prevents the pusher from turning. The hoop can be oriented on the dispenser member and on the reservoir by means of the bushing that is provided with orientation means, such as notches 56. It should also be observed that in the absence of the bushing 5, the dispenser member reverts to a design that is entirely conventional, in which the pusher is held captive. In other words, it is very easy to prevent the pusher from turning by adding the guide bushing 5 in a conventional pump. The addition of the bushing requires no modification to the dispenser member. The bushing 5 can thus be considered as a rotation-preventing accessory to a standard pump or valve.

The invention claimed is:

1. A fluid dispenser member for associating with a fluid reservoir (3), said member comprising:

a body (1);

a fastener ring (2) for holding the body in stationary manner relative to the reservoir (3);

a covering hoop (6) that is engaged in stationary manner around the fastener ring (2);

an actuator rod (15) that is axially movable down and up in the body (1); and a pusher (4) that is mounted on the actuator rod (15), the pusher being provided with a dispenser orifice (44); and blocking means (49, 5, 62) secured to the hoop so as to prevent the pusher from turning on the actuator rod relative to the body, and consequently relative to the reservoir, such that the pusher is movable only axially, the blocking means comprising at least one longitudinal axial guide (55) and a guide bushing that is received in stationary manner in the hoop and that is engaged around the pusher, the bushing forming the at least one longitudinal axial guide; the bushing is surrounded by the hoop and is jammed axially between an inwardly-directed shoulder of the hoop and the fastener ring.

2. A dispenser member according to claim 1, in which said at least one guide comprises an inner axial groove (55).

3. A dispenser member according to claim 1, in which the pusher includes at least one lug (49) that projects outwards, the lug being engaged in a respective longitudinal axial guide (55), the lug and the axial guide forming the blocking means for preventing turning.

4. A dispenser member according to claim 3, in which the axial guide (55) is closed at its top end, such that the lug (49) butts against the guide end when an attempt is made to remove the pusher from the actuator rod, thereby preventing the pusher from being removed from the actuator rod.

5. A dispenser member according to claim 4, in which the hoop includes a top end formed with an inwardly-directed shoulder (62) that closes the top end of the groove (55) formed in the bushing (5).

6. A dispenser member according to claim 1, in which the hoop (6) includes fastener profiles (65) on or in its inside wall, the profiles coming into engagement with the bushing (5) so as to prevent it from turning in the hoop.

7. A dispenser member according to claim 6, in which the profiles (65) also come into engagement with the fastener ring (2) so as to prevent the hoop from turning on the fastener ring.

8. A dispenser member according to claim 1, in which the hoop is made of metal and the bushing is made of plastics material.

9. A dispenser member according to claim 1, in which the blocking means are formed by the hoop.

10. A fluid dispenser comprising a reservoir (3) and a dispenser member according to claim 1, the reservoir presenting a cross-section that is not circular.

11. The dispenser member according to claim 6, wherein the fastener profiles are splines or grooves.

12. A fluid dispenser member for associating with a fluid reservoir (3), said member comprising:

a body;

a fastener ring that holds the body in stationary manner relative to the reservoir;

a covering hoop engaged in stationary manner around the fastener ring;

an actuator rod axially movable down and up in the body; and a pusher that is mounted on the actuator rod, the pusher being provided with a dispenser orifice;

a blocking mechanism secured to the hoop so as to prevent the pusher from turning on the actuator rod relative to the body, and consequently relative to the reservoir, such that the pusher is movable only axially, the blocking mechanism comprising a guide bushing that is received in stationary manner in the hoop and that is engaged around the pusher, the bushing forming at least one longitudinal axial guide; the bushing is surrounded by the hoop and is jammed axially between an inwardly-directed shoulder of the hoop and the fastener ring.

* * * * *